US006360379B1

(12) United States Patent
Lane et al.

(10) Patent No.: US 6,360,379 B1
(45) Date of Patent: Mar. 26, 2002

(54) LOCKING DRAIN COVER

(76) Inventors: Russel Lane, 2 Bowman La.; Andrew C. Quinn, 4 Bowman Ct., both of Clarksburg, NJ (US) 08510

( * ) Notice: Subject to any disclaimer, the term of this patent is extended or adjusted under 35 U.S.C. 154(b) by 0 days.

(21) Appl. No.: 09/713,395

(22) Filed: Nov. 16, 2000

(51) Int. Cl.[7] ..... E04H 4/12
(52) U.S. Cl. ..... 4/507; 4/292; 210/163
(58) Field of Search ..... 4/292, 504, 507; 210/163, 164

(56) References Cited

U.S. PATENT DOCUMENTS 149,489 A * 4/1874 Lewis ..... 210/163 X
929,727 A * 8/1909 Sullivan ..... 4/292
2,800,231 A * 7/1957 Hicks ..... 4/292 X
5,341,523 A * 8/1994 Barnes ..... 4/507
5,734,999 A * 4/1998 Nicholas ..... 4/507

* cited by examiner

*Primary Examiner*—Robert M. Fetsuga
(74) *Attorney, Agent, or Firm*—Charles I. Brodsky

(57) ABSTRACT

A cover for a housing—and particularly for a swimming pool drain—is lockable by a bridge having downwardly extending upper arms and upwardly extending lower arms that are drawn towards one another by a bolt passing through threaded upper and lower hubs for the arms and having a first thread along an upper substantially one-half length thereof and a second opposing thread along a lower substantially one-half length thereof, with the bridge also having bearing feet pivotally connected between adjacent facing ends of the arms to exert increasing pressures against inside surfaces of the housing as the arms are drawn towards one another in securing a rested cover for the housing into a lock position.

16 Claims, 3 Drawing Sheets

LOCKING DRAIN COVER

FIELD OF THE INVENTION

This invention relates to the locking of covers onto housings, in general, and to the locking of a cover on a swimming pool drain, in particular.

BACKGROUND OF THE INVENTION

As will be appreciated, in recent months, there have been increasing reports in the media of children and adults alike being trapped in swimming pool drains—sometimes with very tragic results.

In accordance with the present invention, analysis has revealed that these events have occurred primarily at swim clubs and at condominium swimming pools, rather than at pools at private residences. Further investigation, in accordance with the invention, has revealed that these unfortunate circumstances follow from the inadequacies of the cover for the swimming pool drain—whether the drain be located 6 feet or more below the surface of the water or at only some 12 inch or so below, as in a kiddie pool.

In particular, this investigation has shown that the problem, by and large, results from the typical manner of securing the cover to the drain. With most, if not all the manners of securement being by way of a pair of screws inserted through the plastic cover to fit with a pair of plastic sleeves in the drain housing, it will be easy to understand how the stepping on the cover at the bottom of the pool (for example, in the kiddie pool environment) is able to exert a sideways pressure on the screws in the sleeves, sufficient to break the plastic away freeing, or at the least, loosening the join with the drain. As will be appreciated, this reduces the protection of the cover from the workings of the pump connected to the drain—which is of a capacity to generate hundreds of pounds of suction.

Moreover, the very servicing of large size pools creates problems in-and-of themselves. Typically, swim club and condominium pools are serviced at season's beginning or end, by pulling the cover from the drain and applying large pumps to drain the pool, before putting the cover back in place. On several occasions, the screws that held the cover in position beforehand simply are lost, and not replaced. In other instances, improperly sized screws are reinserted, breaking apart the plastic sleeves which previously held them. Where the serviceperson is aware of this and is conscientious, he, or she, often tries to correct the damage through an application of epoxy (but, that is really nothing more than a temporary fix). And, even at the very most, the repeated taking off, and putting the cover back on after service, has been noted to weaken the securement of the cover onto the drain over time. Because of the horrific consequences which can follow from leaving the drain unprotected, or in a weakened cover condition, a better, more secure drain cover would be highly desirable.

OBJECTS OF THE INVENTION

It is an object of the present invention, therefore, to provide a new and improved cover connection for a swimming pool drain of the type embedded in the concrete or liner of the swimming pool itself.

It is an object of the invention, also, to provide such a cover which can simply be exchanged for those already in use, in affording the increased protection which it is so important to have.

It is object of the present invention, in addition, to provide a cover of this type which can be easily afforded and installed as part of a yearly service call.

SUMMARY OF THE INVENTION

As will become clear from the following description, while the teachings of the present invention are particularly applicable in the context of this swimming pool protection scheme, the constructions described are equally attractive for use where any type of cover is to be secured to a housing. Thus, and as will be described, in accordance with the invention, a bridge is provided having downwardly extending upper arms and upwardly extending lower arms which are arranged to be drawn towards one another upon tightening—and in a manner to bring two or more feet pivotally connected between their adjacent facing surfaces to bear against inside surfaces of the housing to be covered. Thus, in its preferred embodiment, two or more feet are pivotally connected between adjacent first ends of the downwardly extending upper arms and the upwardly extending lower arms of the bridge, with means being included to couple the bridge with the cover in enclosing the bridge within the housing upon which the cover is initially rested. In accordance with this preferred embodiment, second means then cooperate with the first means to rotate the upper and lower arms of the bridge in applying this bearing pressure of the feet against the inside surfaces of the housing in securing the cover in position.

In accordance with the invention, the bridge includes first and second hubs which receive opposing second ends of the downwardly extending upper arms and of the upwardly extending lower arms, respectively, in pivot connection with the first and second hubs. In this embodiment, the first and second means cooperate to rotate the upper extending arms downwardly and the downwardly extending arms upwardly when securing the cover in place—with the arms being equally spaced one from another—as, for example, with three such downwardly extending upper arms and three upwardly extending lower arms spaced at 120° intervals one from another.

In effectuating the securement, the first means includes a bolt extending through the cover in joining with a threaded central core of the two hubs. In such respect, a cap on the bolt serves as the aforesaid second means in rotating the upper and lower arms of the bridge—and in a preferred embodiment of the invention, the bolt includes oppositely oriented threads on its upper and lower ends. Employing, then, a first thread, for example, along an upper substantially one-half length of the bolt and a second opposing thread along a lower substantially one-half length thereof, rotating the bolt in a clockwise direction serves to draw the upper and lower arms toward each other while rotating the bolt in a counterclockwise direction serves to deflect the arms away. In such manner, a serviceperson accessing the bolt by its cap passing through the cover can effectively lock the cover in position by utilizing a ratchet wrench, for example, to rotate the bolt, in bringing the feet up to exert pressure against the inside surfaces of the housing, in securing the cover in position.

In accordance with a preferred embodiment of the invention, the commonly employed plastic cover of "dome" configuration can be utilized, with a 6–8 inch diameter when employed on a swimming pool drain, with a peak of approximately 1 inch at its center. Through an aperture in such cover, the double-threaded bolt is arranged to pass in joining with the threaded cores of the hubs. In a preferred embodiment, a second bolt passes through a second aperture in the cover, to prevent the bridge from swinging about as it is ratcheted open or closed (as by turning the wrench or otherwise tightening or loosening the cap). Recessing the caps of the two bolts within the cover affords further protecting to a user of the pool when either stepping on or accidentally knocking into the cover, wherever it may be used—in a kiddie pool, swimming pool, or elsewhere.

When employed particularly in a swimming pool environment, the housing serving as the drain with the invention can utilize—as it commonly does—side and bottom outlet ports, with the first being threaded to receive a pipe conduit for coupling to the filtration system of the swimming pool, and with the latter being threaded to receive a removable plug for ground water release. As will be appreciated by those skilled in the art, however, the lockable cover in this manner can be used, as well, for any type of housing—and, not only for protecting against the heavy suction of swimming pool filtration equipment.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
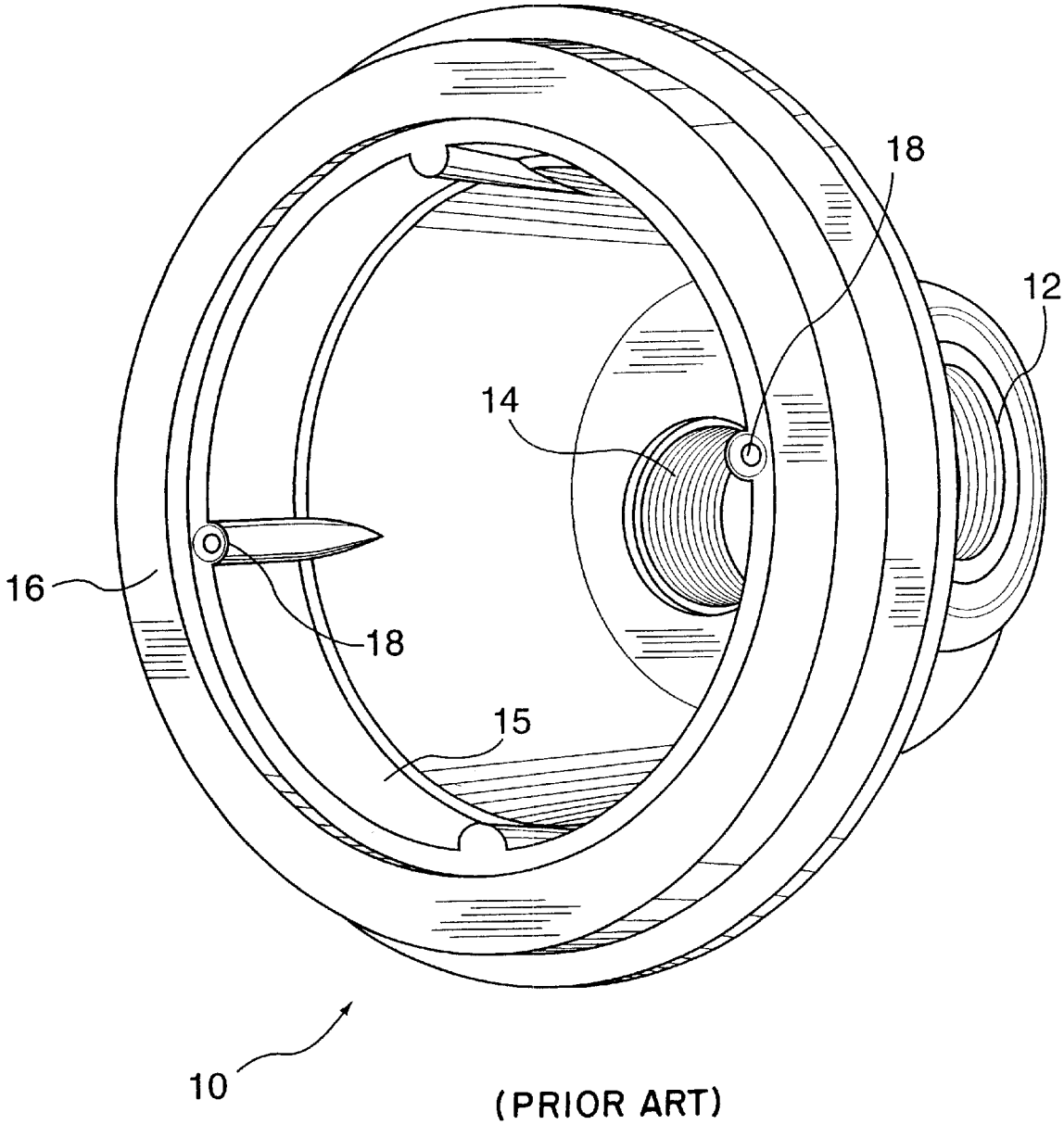
(PRIOR ART) FIG. 1
FIG. 1 is a front perspective view of a type of housing commonly employed as a drain for a type of pool found in swim club and condominium pool constructions.

In FIG. 1, a swimming pool drain type of housing employed in the prior art is shown at 10, having a threaded side outlet port 12 for receiving the conduit piping which couples to the filtration equipment of the pool. A threaded bottom outlet port is shown at 14 to receive a removable plug for ground water relief by removal when the pool is emptied, and for insertion when the pool is filled. As is known and appreciated, removal of the plug allows incipient ground water to seep into the bottom of the pool after emptying, in protecting against pressures on the bottom of the pool from underneath.

More particularly as far as the present invention is concerned, the housing 10 is provided with a lip 16 upon which a cover rests when in position, with the reference notation 18 defining a pair of plastic sleeves in which screws are intended to fit when passing through channels cut into the cover as employed by the prior art to lock the cover to the drain. Such channels for receiving these screws are shown at 20 in FIG. 2—with the understanding that with the commonly employed installation, the screws utilized extend through the channels to mate with and thread into the sleeves 18. Experience has shown, however, that if the screws employed are not of stainless steel, over time they tend to rust in the water, become difficult to disengage and frequently either break themselves, or break off the plastic sleeve 18. Epoxy fixes have proven unsatisfactory, even when applied by a service person aware of the damage done to the sleeve 18.

Figure 2:
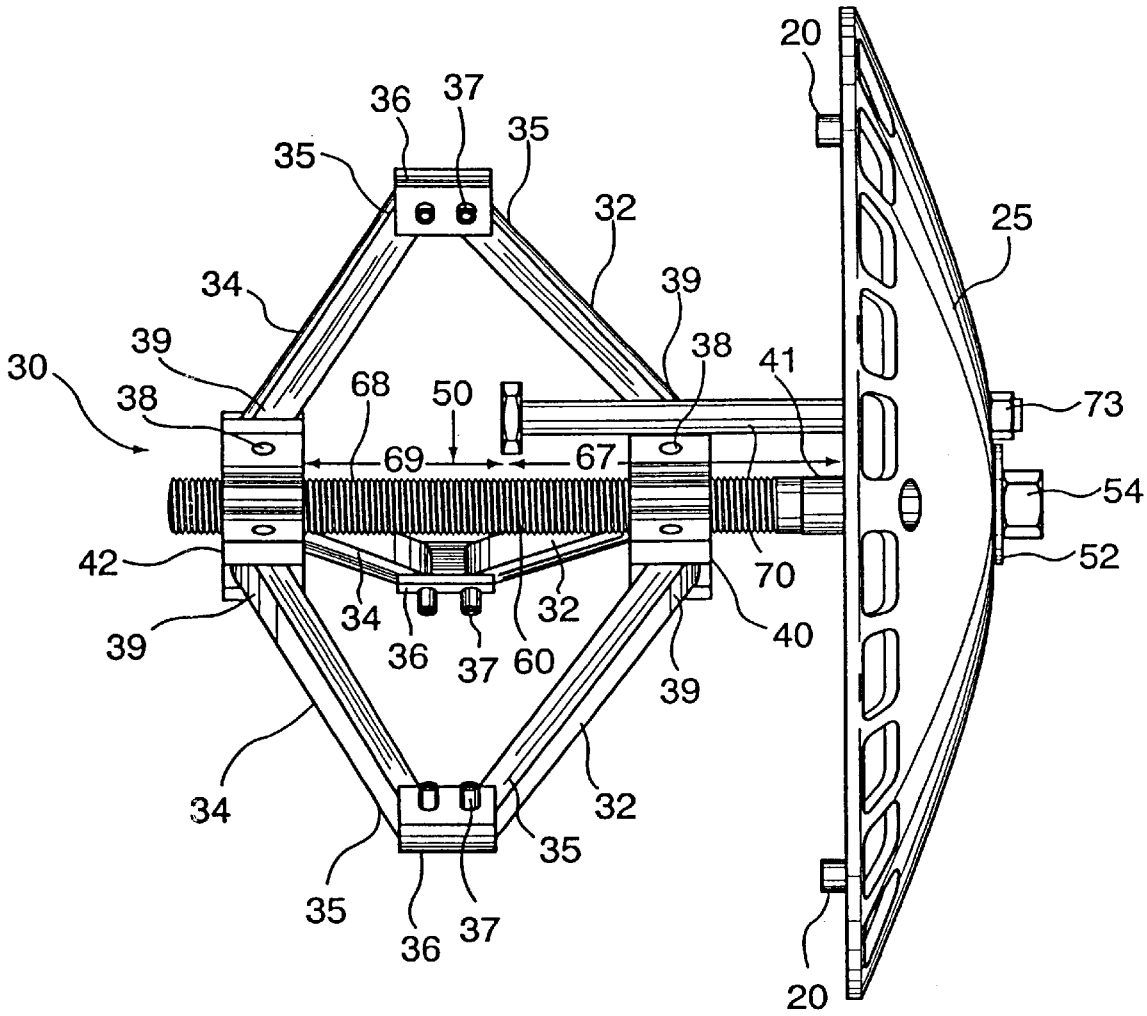
FIG. 2 is a perspective view of the cover for the housing of FIG. 1, showing the bridge design of the present invention.
Figure 3:
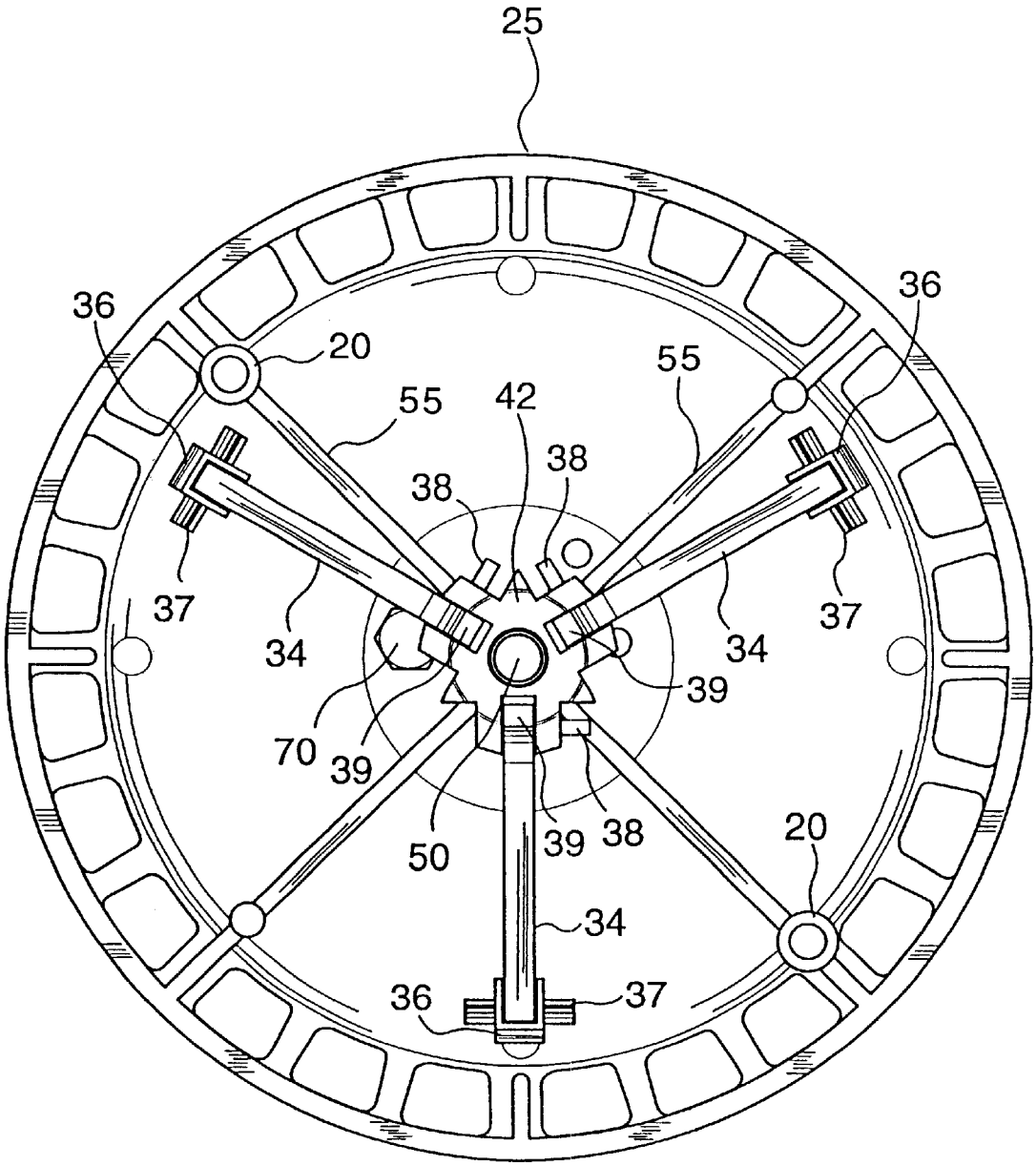
FIG. 3 is a bottom view of the cover and bridge combination of FIG. 2.

But, in accordance with the present invention, on the other hand, a bridge 30 is utilized instead of these screws in effecting the securement between the cover 25 and the drain housing 10. Thus, and as shown in FIGS. 2 and 3, the bridge 30 includes a plurality of downwardly extending upper arms 32 (3 in number, equally spaced 120° apart although 2 or more can be employed, equally spaced from one another), along with a plurality of upwardly extending lower arms 34 (likewise shown as 3, spaced 120° apart in the preferred embodiment). As indicated, 2 or more feet 36 (3, in the preferred embodiment), are pivotally connected between adjacent first ends 35 of the downwardly extending upper arms 32 and the upwardly extending lower arms 34, as by pins 37. Through use of similar pins 38, the opposing second ends 39 of the downwardly extending upper arms 32 and the upwardly extending lower arms 34 are joined to a pair of hubs 40, 42 having a centrally threaded core. In accordance with the invention, a bolt 50 is provided which couples the bridge 30 to the cover 25, by passing through a washer 52 and an aperture in the center of the cover 25, which is "domed" as with conventionally employed covers, to a peak of some 1 inch. A second washer 41 receives the uppermost end of the bolt 50, in limiting the upward movement of the bolt 50 into the cover 25 by its fitting within vanes 55 conventionally provided to the undersurface of the typical cover.

In accordance with this preferred embodiment, the bolt 50 extends through the threaded cores of each of the hubs 40, 42 and is of a dual fabrication. More specifically, the bolt 50 is provided with oppositely oriented threads on its upper and lower ends—as with a first thread 60 along substantially its upper one-half length 67 and with a second opposing thread 68 along its lower substantially one-half length 69. As will be appreciated, then, rotating the bolt 50—as by means of its cap 54 effectively serves to lower the upper arms 32 and raise the lower arms 34 when rotated in a clockwise direction, drawing the arms toward one another. Conversely, rotating the cap 54 in a counterclockwise direction (both, for example, with a ratchet wrench) does the opposite, in raising the upper arms 32, towards the cover 25 while deflecting the lower arms 34 further away. In accordance with a preferred embodiment of the invention, the cover 25 may be recessed at its center in receiving the cap 54 to provide the cover 25 with a smooth top surface. As will be understood by those skilled in the art, rotating the bolt 50 counterclockwise not only raises the lower arms 34 and lowers the upper arms 32 in this manner, but also rotates the feet 36 outwardly and horizontally from the position shown in FIG. 2, in serving to bear the feet 36 against the inside surfaces of the housing 10, as at 15. Continuing rotation of the bolt 50 by means of the wrench serves to increase the pressure of the feet 36 on the surface 15, tightening and fixing the cover 25 in position atop the housing 10 where it was initially placed.

FIG. 2 further illustrates the addition of a second bolt 70 likewise passing through an aperture in the cover 25. Such second bolt is selected of a length to extend inwardly of the housing at least as far as the upper hub 40. As the rotation of the bolt 50 in tightening the securement by drawing the upper and lower arms 32 and 34 towards one another also has the tendency to rotate the entire bridge 30, the second bolt 70 serves as a "stop" to any "swinging" of the bridge 30 brought about the tightening. As will be seen, this "swinging" of the bridge 30 follows on both clockwise and counterclockwise rotation of the bolt 50 in tightening or loosening the drain cover 25 either after or before servicing of the drain, or its two outlet ports 12, 14. The cover 25 may also be recessed to receive the cap 73 of the bolt 70.

With the invention as described, therefore, rotation of the cap 54 by the serviceperson's wrench serves to allow removal of the cover 25 for service, for maintenance, and for the attachment of various pump equipment to empty the pool or to winterize it, while rotation of the cap 54 in the opposite direction fastens the cover 25 with the housing 10. In neither respect are the two plastic sleeves 18 employed, nor are the screws utilized by the prior art to secure the cover 25 and housing 10 together—thereby eliminating the problem with the screws which investigation showed led to the displacement or removal of the cover 25 from the housing 10, and possibly leading to the tragic results and consequences of swimming pool users getting their hair, their arms or their legs caught in the drain under the tremendous suction generated by the swimming pool's filtration systems. The cover and bridge of the invention can then simply be substituted for the typical cover employed for the drain according to the prior art, being obtainable at an affordable price and installed at the time of the next scheduled service call. Of course, in so doing, the inserted threading of the bolt 50 could be made so that its counterclockwise rotation tightens the cover, instead, while a clockwise rotation loosens it—either manner being in accordance with the invention.

While there have been described what are considered to be preferred embodiments of the present invention, it will be readily appreciated by those skilled in the art that modifications can be made without departing from the scope of the teachings herein—either of using the cover to close off a swimming pool drain, or to just close off any type of housing to begin with. For at least such reason, therefore, resort should be had to the claims appended hereto for a true understanding of the scope of the invention.

We claim:

1. The combination comprising:

a housing;

a cover for said housing;

a bridge having downwardly extending upper arms and upwardly extending lower arms;

two or more feet pivotally connected between adjacent first ends of said downwardly extending upper arms and said upwardly extending lower arms of said bridge;

first means coupling said bridge with said cover for enclosing said bridge within said housing when rested thereupon by said cover; and second means cooperating with said first means for rotating said upper and lower arms of said bridge to pressure bear said feet against inside surfaces of said housing in securing said rested cover in position.

2. The combination of claim 1 wherein said bridge includes first and second hubs for receiving opposing second ends of said downwardly extending upper arms and said upwardly extending lower arms, respectively.

3. The combination of claim 2 wherein said opposing second ends of said downwardly extending upper arms and said upwardly extending lower arms are pivotally connected with said first and second hubs, respectively.

4. The combination of claim 3 wherein said second means cooperates with said first means for rotating said upwardly extending arms downwardly and said downwardly extending arms upwardly in securing said cover in position.

5. The combination of claim 4 wherein said downwardly extending upper arms and upwardly extending lower arms are disposed at intervals equally spaced one from another.

6. The combination of claim 5 wherein said bridge includes three downwardly extending upper arms and three upwardly extending lower arms at equally spaced 120° intervals from one another.

7. The combination of claim 5 wherein said first means includes a bolt extending through said cover in joining with a threaded central core of said first and second hubs.

8. The combination of claim 7 wherein said second means includes a cap on said bolt for rotating said bolt.

9. The combination of claim 8 wherein cap is adjustable for varying the bearing pressure of said feet against said surfaces of said housing.

10. The combination of claim 9 wherein said housing includes side and bottom outlet ports.

11. The combination of claim 10 wherein said side outlet port is threaded and wherein said bottom outlet port is threaded.

12. The combination of claim 8 wherein said bolt includes oppositely oriented threads on upper and lower ends thereof.

13. The combination of claim 12 wherein said bolt includes a first thread along an upper substantially one-half length thereof and a second opposing thread along a lower substantially one-half length thereof.

14. The combination of claim 13 wherein said cover is domed, with a peak of approximately one inch at a center thereof having a first aperture through which said bolt extends.

15. The combination of claim 14 wherein said cap is recessed within said cover.

16. The combination of claim 14 wherein said cover includes a second aperture, and wherein there is also included a second bolt extending through said second aperture a distance to reach said first hub.

* * * * *